US009121668B1

(12) United States Patent
Edwards

(10) Patent No.: US 9,121,668 B1
(45) Date of Patent: Sep. 1, 2015

(54) AERIAL VEHICLE WITH COMBUSTIBLE TIME-DELAY FUSE

(71) Applicant: Raytheon Company, Waltham, MA (US)

(72) Inventor: Jeffrey C Edwards, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/179,639

(22) Filed: Feb. 13, 2014

(51) Int. Cl.

| | |
|---|---|
| ***F41G 7/22*** | (2006.01) |
| ***F42B 15/01*** | (2006.01) |
| *F41G 7/00* | (2006.01) |
| *H01Q 1/42* | (2006.01) |

(52) U.S. Cl.
CPC .. *F41G 7/22* (2013.01); *F42B 15/01* (2013.01)

(58) Field of Classification Search
CPC ..... F24B 10/02; F24B 10/14; F24B 10/20; F24B 4/06; F24B 4/08; F24B 4/10; F24B 4/12; F24B 4/14; F24B 15/01; H01Q 1/42; H01Q 1/428; F41G 7/20; F41G 7/22; F41G 7/2273; F41G 7/2286; F41G 7/2293
USPC ..... 244/3.1, 3.15–3.3, 158.1, 158.3–158.5; 343/872; 446/34, 49, 50, 51, 52; 102/335, 347–352, 354, 356, 357, 360
See application file for complete search history.

(56) References Cited

U.S. PATENT DOCUMENTS

| | | | | | |
|---|---|---|---|---|---|
| 847,198 | A | * | 3/1907 | Maul | 102/348 |
| 1,299,217 | A | * | 4/1919 | Pain | 102/351 |
| 1,567,267 | A | * | 12/1925 | Hitt | 102/349 |
| 2,841,084 | A | * | 7/1958 | Carlisle | 102/348 |
| 2,922,367 | A | * | 1/1960 | Werner | 244/3.22 |
| 3,202,998 | A | * | 8/1965 | Hoffman | 244/158.3 |
| 3,706,281 | A | | 12/1972 | Hatakeyama | |
| 3,891,162 | A | * | 6/1975 | Wolterman | 244/3.25 |
| 5,368,255 | A | | 11/1994 | August | |
| 5,474,256 | A | | 12/1995 | Garner | |
| 5,760,330 | A | * | 6/1998 | Himmert et al. | 102/351 |
| 6,435,097 | B1 | | 8/2002 | Garner et al. | |
| 6,880,780 | B1 | * | 4/2005 | Perry et al. | 244/3.27 |
| 7,093,799 | B1 | | 8/2006 | Dulat et al. | |
| 8,058,597 | B2 | | 11/2011 | Geswender | |
| 8,183,508 | B1 | | 5/2012 | Sankovic | |
| 8,445,823 | B2 | * | 5/2013 | Williams et al. | 244/3.16 |
| 2005/0000383 | A1 | | 1/2005 | Facciano et al. | |
| 2007/0074636 | A1 | | 4/2007 | Rieger et al. | |

* cited by examiner

*Primary Examiner* — Bernarr Gregory
(74) *Attorney, Agent, or Firm* — Renner, Otto, Boisselle & Sklar, LLP

(57) ABSTRACT

An air vehicle includes a combustible fuse that is used for time-delayed release of a retention device. Combustion of a combustible propellant for propelling the air vehicle initiates combustion of the fuse. After a time delay following initiation of the combustion of the fuse, a retention device of air vehicle is released. In one embodiment, the air vehicle is a projectile which is fired from a propellant in a cartridge that is behind the projectile. The retention device may be used to release a cover for a sensor of the air vehicle, such as a cover for an optical sensor or seeker.

20 Claims, 4 Drawing Sheets

AERIAL VEHICLE WITH COMBUSTIBLE TIME-DELAY FUSE

BACKGROUND OF THE INVENTION

1. Technical Field of the Invention

The invention is in the field of aerial vehicles with time-delay release mechanisms.

2. Description of the Related Art

Aerial vehicles such as projectiles or missiles have had parts that are releasable in flight, such as covers for sensor systems. In the past pyrotechnic devices have been used in separating covers, but initiating circuits for squibs or other pyrotechnic devices increase cost and complexity. Explosives also cause vibrations in the vehicle that may disrupt operations of systems in the aerial vehicle, for example temporarily disrupting operation of an inertial measurement unit. Further, safety precautions are required for handling during manufacture, storage, and transportation of the aerial vehicle.

SUMMARY OF THE INVENTION

An aerial vehicle includes a combustible time-delay fuse for releasing a part of the vehicle during flight.

According to an aspect of the invention, an air vehicle includes: a combustible propellant that propels the air vehicle; and a retention device for retaining a part of the air vehicle. The retention device is part of a combustible time-delay fuse, combustion in which is initiated by combustion of the combustible propellant, and which after a time delay from initiation of combustion of the fuse, releases the retention device.

According to another aspect of the invention, a method of releasing a part of an air vehicle during flight includes the steps of: launching the air vehicle, where in the launching includes igniting a combustible propellant of the air vehicle, with the part of the air vehicle retaining during launching by a retention device of the air vehicle; initiating combustion of a combustible time-delay fuse by combustion of the propellant; and releasing the retention device by sufficient combustion of the fuse, thereby releasing the part of the air vehicle.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

DETAILED DESCRIPTION

An air vehicle includes a combustible fuse that is used for time-delayed release of a retention device. Combustion of a combustible propellant for propelling the air vehicle initiates combustion of the fuse. After a time delay following initiation of the combustion of the fuse, a retention device of air vehicle is released. In one embodiment, the air vehicle is a projectile which is fired from a propellant in a cartridge that is behind the projectile. The retention device may be used to release a cover for a sensor of the air vehicle, such as a cover for an optical sensor or seeker.

Figure 1:
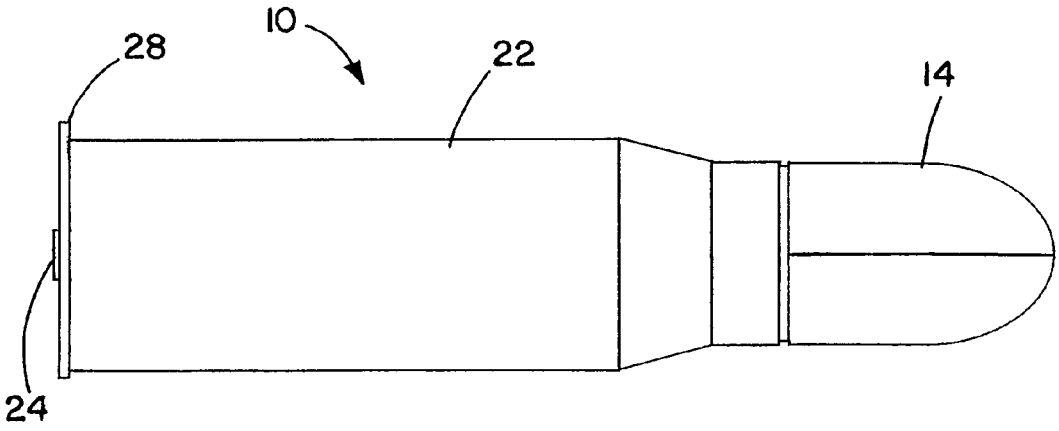
FIG. 1 is a side view of a projectile in accordance with an embodiment of the invention.
Figure 2:
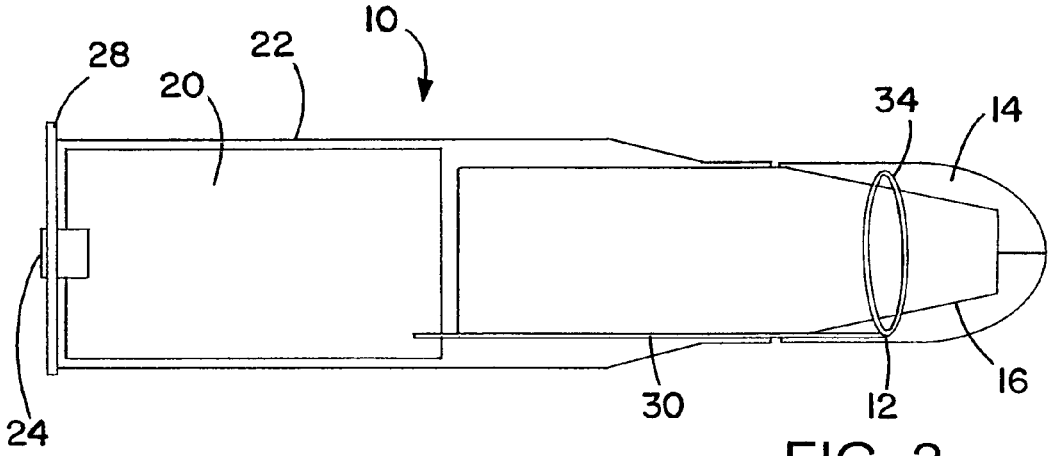
FIG. 2 is a side cross-sectional view of the projectile of FIG. 1.

FIGS. 1 and 2 show a projectile 10, an example of an air vehicle that includes a combustible fuse 12 for releasing or separating a part of the projectile 10, a cover 14 that covers a sensor 16 at the front of the projectile 10. The sensor 16 may be used in guiding the projectile 10.

The projectile 10 is propelled using a combustible propellant 20 that is located in a cartridge case 22 of the projectile 10. The propellant 20 is ignited using an ignition primer 24 at a base 28 of the case 22.

A tail 30 of the fuse 12 extends back from the cover 14 into the propellant 20. Combustion of the propellant 20 initiates combustion of the fuse tail 30. The fuse 12 burns forward from the propellant 20, toward a retention portion or device 34 of the fuse 12, such as a retention band, that is engaged with the cover 14, and that keeps the cover 14 from being prematurely released. There is a time delay between the initiation of combustion of the fuse tail 30, and when the combustion reaches the fuse retention portion 34, which causes release of the cover 14. This time delay is a function of the material characteristics of the fuse tail 30, and the dimensions of the fuse tail 30, among other possible factors. By proper configuration of the fuse 12, a desired time delay between initiation of propellant combustion and release of the cover 14 may be achieved.

Figure 3:
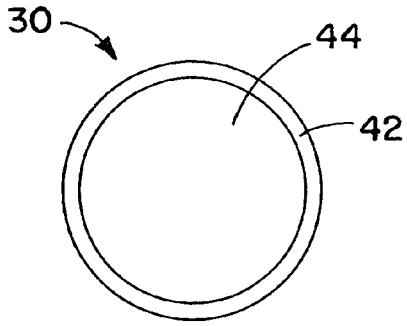
FIG. 3 is a cross-sectional view of the fuse tail of the combustible fuse of the projectile of FIGS. 1 and 2.

The fuse 12 may be made of any of a wide variety of combustible materials. For example, the fuse 12 may include a fabric, such as canvas or a synthetic fabric, that is impregnated with gunpowder or potassium nitrate, similar to materials used for cannon fuse. With reference to FIG. 3, there may be a coating or covering 42 on the outside of the combustible fuse 12, such as a lacquer or plastic coating, that confines combustion to an internal core 44 of the fuse 12. These are only examples of a few of the many ways that the fuse 12 can be configured.

The entire fuse 12 may be made of combustible material. Alternatively, only part of the fuse 12 may be combustible, with for instance the fuse tail 30 being combustible, and the retention portion 34 being combustible only to the degree necessary to release the cover 14 after combustion of the combustible parts of the fuse 12. The noncombustible retention portion 34 may be made of any of a variety of suitable materials, for instance suitable plastic materials.

The fuse 12 may have any of a variety of suitable shapes. The fuse tail 30 may have a substantially circular cross section. The tail 30 may be straight, longitudinally oriented along an inner surface of the case 22, as shown in FIG. 2. Alternatively the tail 30 may take a more circuitous route from the propellant 20 to the retention band 34, for example spiraling around the inside of the case 22. The tail 30 may run in a suitable channel, groove, or tunnel, along the inner surface of the case 22. The tail 30 may be secured in the groove, channel, or tunnel, by a suitable epoxy, or by other suitable mechanisms.

The retention portion 34 may have a flattened shape, and may be connected to the cover 14 by any of a variety of suitable methods, such as by being adhesively attached to the cover 14. The retention portion 34 may be on the inside of the cover 14, or alternatively may be on the outside of the cover 14, with the tail 30 passing through a hole in the cover 14. If the retention portion 34 is on the outside of the cover 14, it may be in a suitable groove in the cover 14, perhaps with an epoxy covering to protect it from ablation and/or to reduce drag.

As noted above, the fuse 12 is a combustible retention device that relies on combustion to release the retention portion 34. This is in contrast to pyrotechnic explosive devices, which use an explosive force to cause separation.

The time delay provided by the fuse 12 may be set to any of a wide variety of times. For example, the time delay may be from 1 second to 30 seconds, although other time delays are possible. The time delay may be controlled by selection and configuration of the fuse 12 using any or all of the variables described above.

The fuse 12 may be used to keep the cover 14 in place for a predetermined time after combustion of the propellant 20 commences. The cover 14 may protect the sensor 16 during launching, as well as during the initial phase of flight of the projectile 10. For example the cover 14 may protect the sensor 16 from objects in the air, such as dust or sand, that may otherwise ablate or otherwise damage the sensor 16. In addition, the cover 14 may provide better aerodynamic performance (e.g., less drag) than the uncovered sensor 16.

Figure 4:
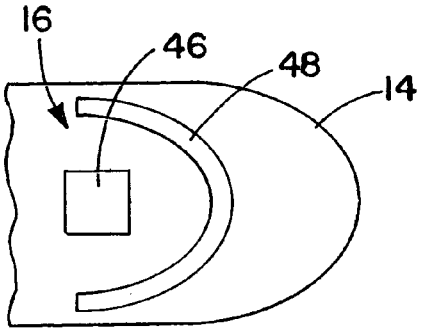
FIG. 4 is a side view showing a projectile in accordance with an alternate embodiment of the invention.

The sensor 16 may be any of a variety of types of sensors. The sensor 16 may be an optical sensor, such as an optical seeker. Alternatively, as shown in FIG. 4, the sensor 16 may be a radar seeker 46, for example with a radome 48 of the radar seeker 46 exposed to the airstream when the cover 14 is removed.

The projectile 10 may be fired from a gun or other suitable launcher, with the propellant 20 used to propel the projectile 10 out of the launcher. Alternatively or in addition, the propellant 20 may power the air vehicle (the projectile or the missile, for example) during flight.

Figure 5:
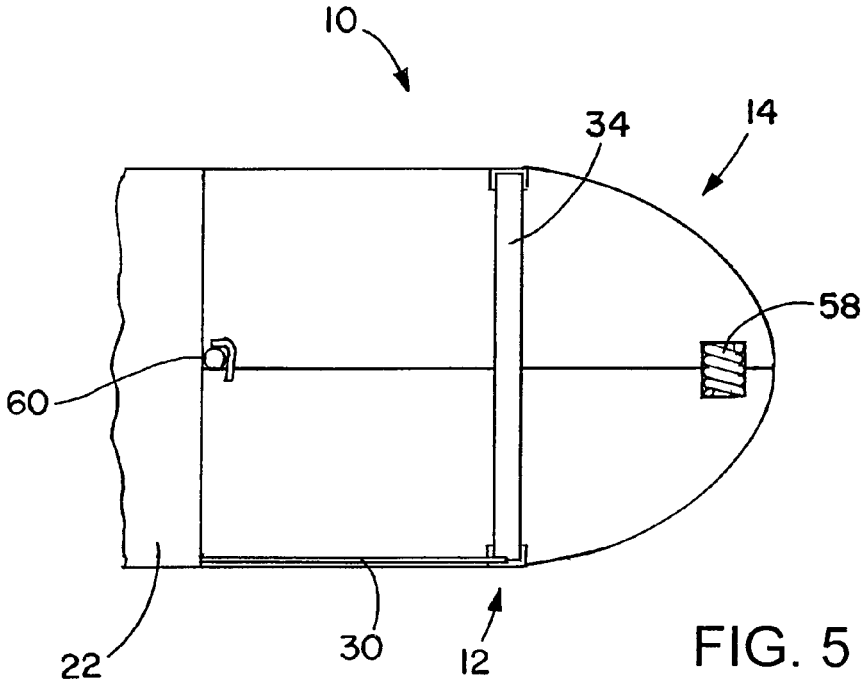
FIG. 5 is a side view illustrating a first step in the removal of the cover of the projectile of FIG. 1.
Figure 6:
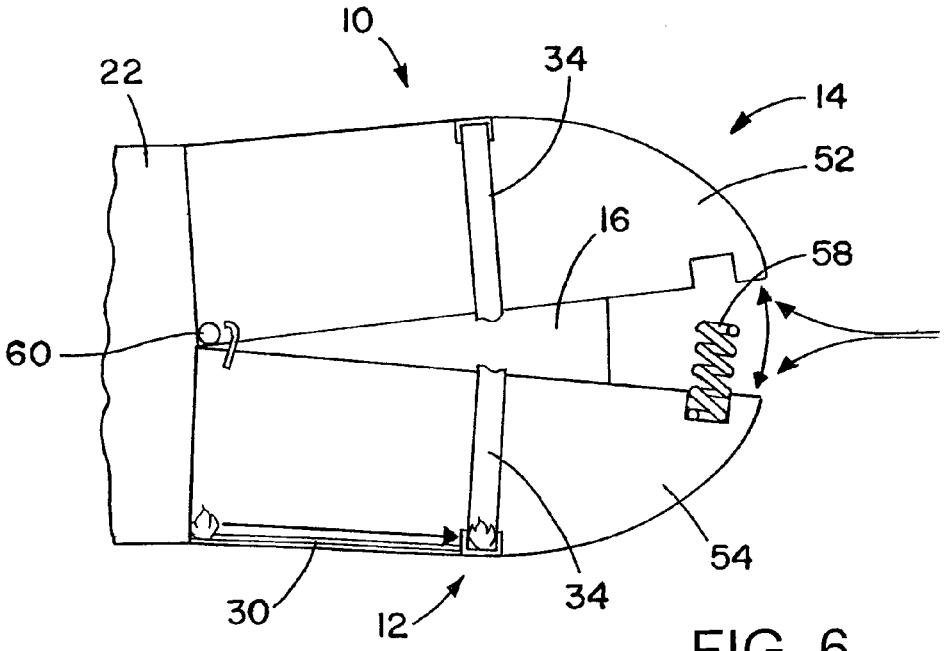
FIG. 6 is a side view illustrating a second step in the cover removal.
Figure 7:
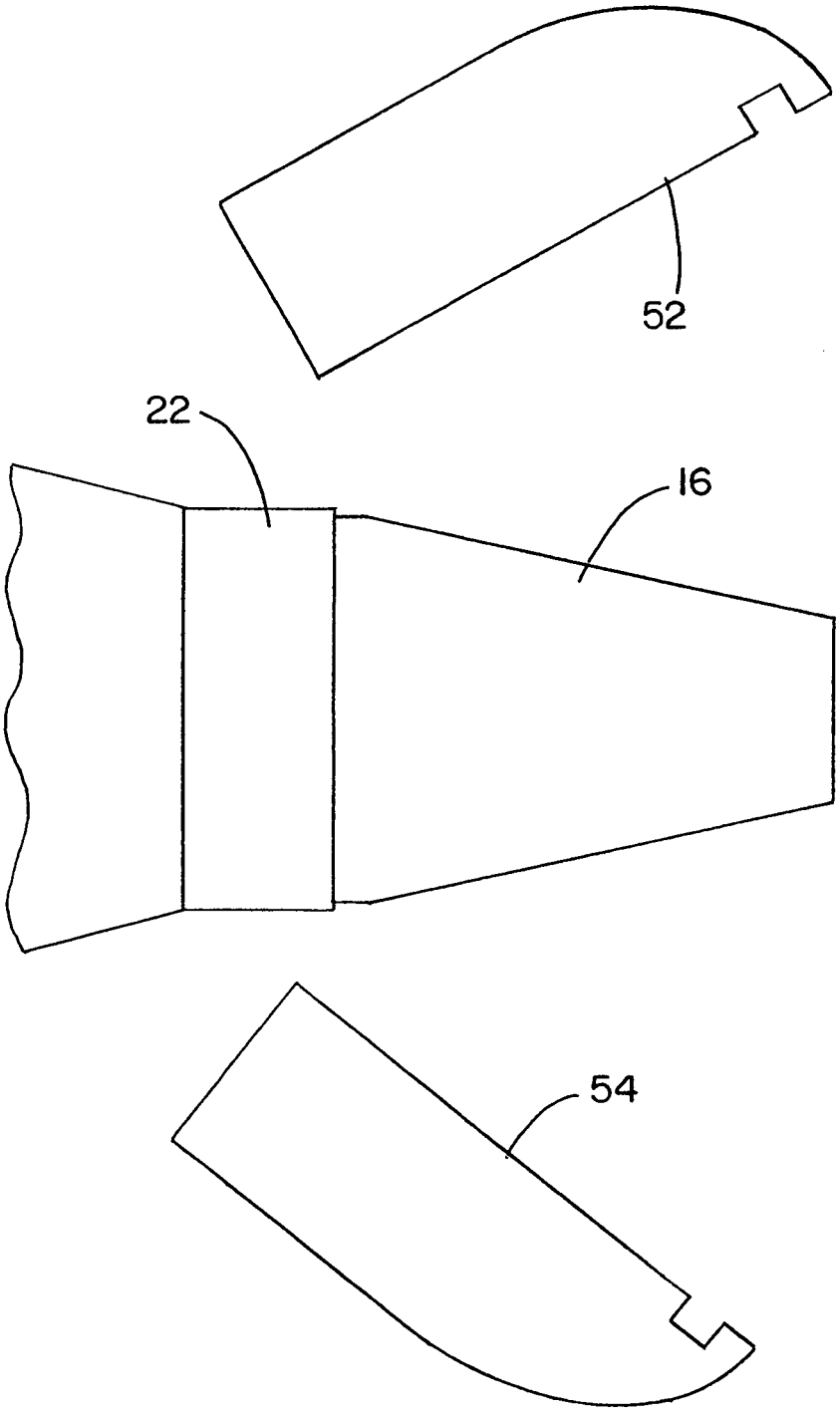
FIG. 7 is a side view illustrating a third step in the cover removal.

FIGS. 5-7 illustrate the process of release of the cover 14. FIG. 5 shows situation prior to release of the cover 14, with cover parts 52 and 54 held together by the fuse retention portion 34. The cover parts 52 and 54 may be sealed where they abut or overlap, at a joint 56, by a suitable seal against moisture and/or dirt, such as an RTV silicone seal. The sealing material may be omitted if desired.

The retention portion 34 holds the cover parts 52 and 54 against a separation force from a resilient device 58, illustrated as a spring. The resilient device 58 provides an initial force to aid in separating the cover parts 52 and 54 after release of the retention portion 34, as discussed below. In addition the resilient device 58 may provide an outward force that helps hold the retention portion 34 in place, prior to release. In the illustrated embodiment the cover parts 52 and 54 are held together at a releasable hinge 60, allowing the cover parts 52 and 54 to pivot outward when released.

FIG. 6 shows the beginning of the separation of the cover 14 from the rest of the projectile 10. The fuse tail 30 has burned to the point where the retention device 34 breaks or otherwise releases the cover parts 52 and 54. The resilient device 58 provides an outward force for the cover parts 52 and 54 to pivot outward about the hinge 60 (and the casing 22). This separates the front ends of the cover parts 52 and 54, exposing them to the airstream, and allowing aerodynamic forces to further separate the cover parts 52, and 54. Finally, as shown in FIG. 7, the cover parts 52 and 54 fall away from the rest of the projectile 10, exposing the sensor 16 as the projectile 10 continues on its flight.

The resilient device 58 may be a spring or other resilient device, in any of a variety of forms, to provide a preloaded force to initiate separation of cover parts 52 and 54, once the retention device 34 is released. The device 58 may be a coil spring, as is illustrated in FIGS. 5 and 6, or may alternatively be other types of springs or other devices. As a further alternative, other sorts of devices may be used to provide an initial separation force on the cover parts 52 and 54. Or the cover parts 52 and 54 may be configured to separate purely through the action of aerodynamic forces, without any other separation force being applied to them. For example a suitable shape for the cover parts 52 and 54 may allow them to use the airflow around them to induce a separating force in the manner of an airfoil.

The cover parts 52 and 54 may separate in other ways than are shown in FIGS. 5-7. For example the hinge 60 may be eliminated or configured differently, with the cover parts 52 and 54 moving in different suitable ways to separate from the rest of the projectile 10.

In the illustrated embodiment there are only two cover parts 52 and 54. Alternatively there may a different number of cover parts and/or a different configuration of the cover parts. For example, there may be four or six cover pieces. Making the cover pieces smaller has the advantage that lighter pieces falling away from the projectile 10 form less of a hazard to people or devices on the ground, such as friendly personnel in the area of the projectile 10.

The retention device 34 is shown as a retention band that breaks in order to release the cover parts 52 and 54. Many alternative types of retention devices are possible. For example the retention device may be some sort of releasable mechanical latch that is released by combustion of a fuse such as all or part of the fuse 12.

Many variations are possible. The air vehicle may be a missile, or a powered or unpowered projectile, to give a few examples. Propellant used to initiate combustion of a time-delay fuse may be part of a solid-fuel rocket, or a gun cartridge that provide pressurized gasses within a launcher. The time-delay fuse mechanism described above may be used to retain other parts of an air vehicle, which may be separated, deployed, or otherwise changed in configuration following release of a retention mechanism.

Figure 8:
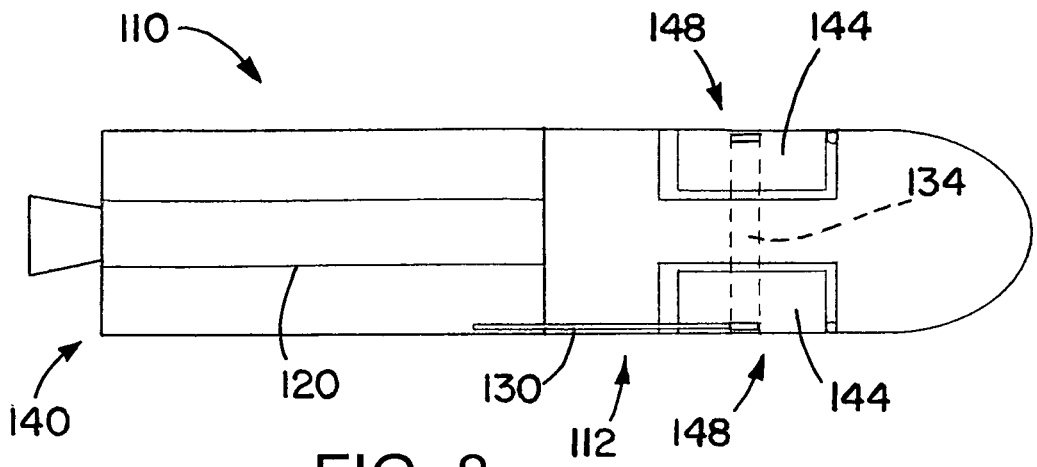
FIG. 8 is a side view of a missile in accordance with an alternate embodiment of the invention.
Figure 9:
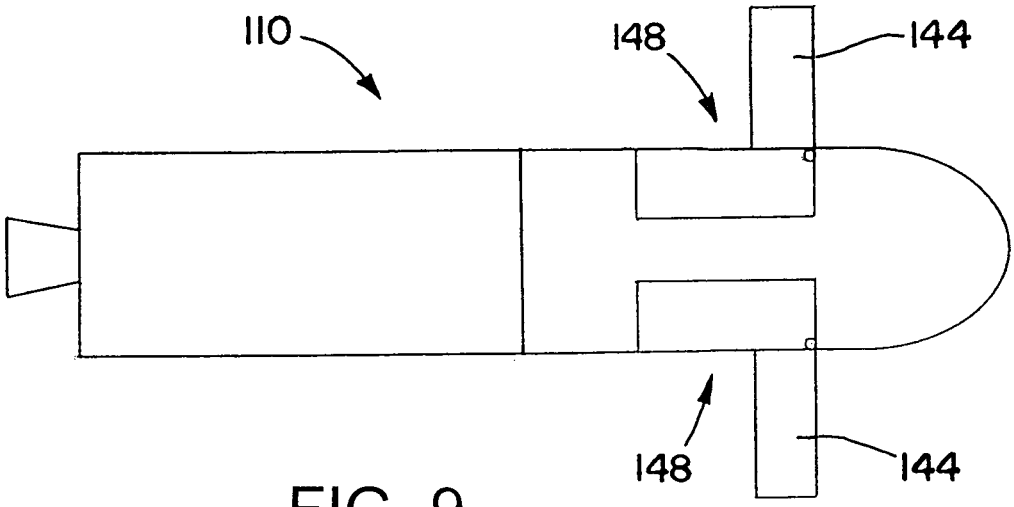
FIG. 9 is a cross-sectional view of the missile of FIG. 8.

FIGS. 8 and 9 show one variant, a missile 110 that includes a combustible fuse 112 that has a tail 130 that is include a rocket motor 140 with a solid propellant 120. Burning of the propellant 120 causes combustion in the fuse tail 130, which leads after a time delay to release of a retention device 134 that is part of the fuse 112. As shown in FIG. 9, release of the retention device 134 allows deployment of flight surfaces, such as canards 144, which prior to release are held in slots 148 in the missile 110. The canards 144 may be spring loaded so as to deploy as soon as the retention device 134 is released. Retention devices such as described above may be used for time-delayed release of any of a variety of other deployable structures, such as other deployable flight control surfaces, such as wings or fins.

The fuses described above provided numerous advantages over prior release mechanisms such as explosives, for example in the form of one or more explosive bolts. The fuses described above avoid use of explosives that may cause vibrations that interfere with operations of components of the sensor or other parts of the aerial vehicle, such as an inertial measurement unit. Also, explosives have relied upon electrical ignition, which adds weight and complexity, and may require running a wire between the vehicle main body and a cover or other item to be released. Further, using combustible materials instead of explosive materials avoids the precautions that are associated with explosives, for example during manufacture, transportation, and storage of devices that include explosive materials.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An air vehicle comprising:

a combustible propellant that propels the air vehicle;

a combustible time-delay fuse having a combustible portion that is configured to be ignited by the combustible propellant; and a retention device for retaining a part of the air vehicle, the retention device being at least partially formed by the combustible portion of the combustible time-delay fuse such that combustion of the combustible portion reduces a tensile strength of the retention device;

wherein combustion of the combustible time-delay fuse is initiated by combustion of the combustible propellant, and which after a time delay from initiation of combustion of the fuse, releases the retention device based on the reduced tensile strength of the retention device.

2. The air vehicle of claim 1, wherein the fuse includes a combustible fuse tail that extends into the propellant.

3. The air vehicle of claim 1, wherein the retention device is a retention band that extends around the air vehicle.

4. The air vehicle of claim 1, wherein the fuse includes a fabric material.

5. The air vehicle of claim 1, wherein the fuse includes a combustible core material surrounded a non-combustible outer sheath.

6. The air vehicle of claim 1, further comprising one or more resilient devices to move the part of the air vehicle, once the retention device is released.

7. The air vehicle of claim 1, wherein the part of the air vehicle is a separable object that separates from the air vehicle when the retention device is released.

8. The air vehicle of claim 7, wherein the separable object is a cover for a sensor of the air vehicle.

9. The air vehicle of claim 8, wherein the sensor is an optical sensor.

10. The air vehicle of claim 8, wherein the sensor is a seeker.

11. The air vehicle of claim 10, wherein the seeker is an optical seeker.

12. The air vehicle of claim 10, wherein the seeker is a radar seeker, with the cover covering a radome of the seeker, prior to release of the retention device.

13. The air vehicle of claim 1, wherein the part of the air vehicle is a deployable object that deploys when the retention device is released.

14. The air vehicle of claim 13, wherein the deployable object is a flight control surface.

15. An air vehicle comprising:

a combustible propellant that propels the air vehicle;

a combustible time-delay fuse configured to be ignited by the combustible propellant; and a retention device for retaining a part of the air vehicle, the part of the air vehicle being a separable object that separates from the air vehicle when the retention device is released, wherein the separable object is a cover for a sensor of the air vehicle;

wherein the retention device is part of the combustible time-delay fuse, combustion in which is initiated by combustion of the combustible propellant, and which after a time delay from initiation of combustion of the fuse, releases the retention device; and wherein the cover includes multiple cover pieces that separate from one another once the retention device is released.

16. The air vehicle of claim 15, wherein the cover pieces are hingedly coupled to a casing of the projectile.

17. The air vehicle of claim 15, further comprising a resilient device that separates the cover pieces from one another after release of the retention device.

18. A method of releasing a part of an air vehicle during flight, the method comprising:

launching the air vehicle, where in the launching includes igniting a combustible propellant of the air vehicle, with the part of the air vehicle retaining during launching by a retention device of the air vehicle, the retention device being at least partially formed by a combustible portion of a combustible time-delay fuse;

retaining the part with a force of the retention device, the force based on a tensile strength of the retention device;

initiating combustion of the combustible time-delay fuse by combustion of the propellant, wherein combustion of the fuse reduces a tensile strength of the retention device; and releasing the retention device by combustion of at least a portion of the combustible portion of the fuse, thereby reducing the tensile strength of the retention device and releasing the part of the air vehicle based on the reduced tensile strength of the retention device.

19. The method of claim 18, wherein the combustion of the fuse is initiated in a combustible tail of the fuse that extends into the propellant.

20. The method of claim 18, wherein the time delay between initiating combustion of the fuse and release of the retention device is at least 1 second.

* * * * *